United States Patent [19]

Elsässer et al.

[11] 4,415,642

[45] Nov. 15, 1983

[54] ELECTROPHOTOGRAPHIC MEMBER OF SE-TE-AS WITH HALOGEN

[75] Inventors: Kurt Elsässer; Helmut Ebner; Armin Baumgärtner, all of Nuremberg, Fed. Rep. of Germany

[73] Assignee: International Standard Electric Corporation, New York, N.Y.

[21] Appl. No.: 382,916

[22] Filed: May 28, 1982

[30] Foreign Application Priority Data

Jun. 13, 1981 [DE] Fed. Rep. of Germany ..... 3123608

[51] Int. Cl.[3] ..... G03G 5/082; G03G 5/09

[52] U.S. Cl. ..... 430/86; 430/95; 252/501.1; 420/579

[58] Field of Search ..... 430/85, 86, 95; 252/501.1; 420/579

[56] References Cited

FOREIGN PATENT DOCUMENTS

| | | | |
|---|---|---|---|
| 2002624 | 8/1970 | Fed. Rep. of Germany | 430/86 |
| 7604387 | 4/1976 | Netherlands | 430/85 |
| 1441447 | 6/1976 | United Kingdom | 430/86 |

*Primary Examiner*—Roland E. Martin, Jr.

*Attorney, Agent, or Firm*—T. E. Kristofferson; A. D. Stolzy

[57] ABSTRACT

The metal substrate of an electrophotographic member is provided with a selenium-tellurium alloy layer containing 5–30% tellurium, 10–5,000 ppm of a metallic element of the fifth main group, and 10–100 ppm of a halogen. A preferred embodiment contains 15% tellurium, 40 ppm arsenic, and 40 ppm chlorine. The addition of the metallic element of the fifth main group to the selenium-tellurium alloy results in a stabilization of charging potentials in multicycle operation.

If the metal substrate is an aluminum drum, the electrophotographic member can be used as a copying drum in high-speed copiers.

1 Claim, 1 Drawing Figure

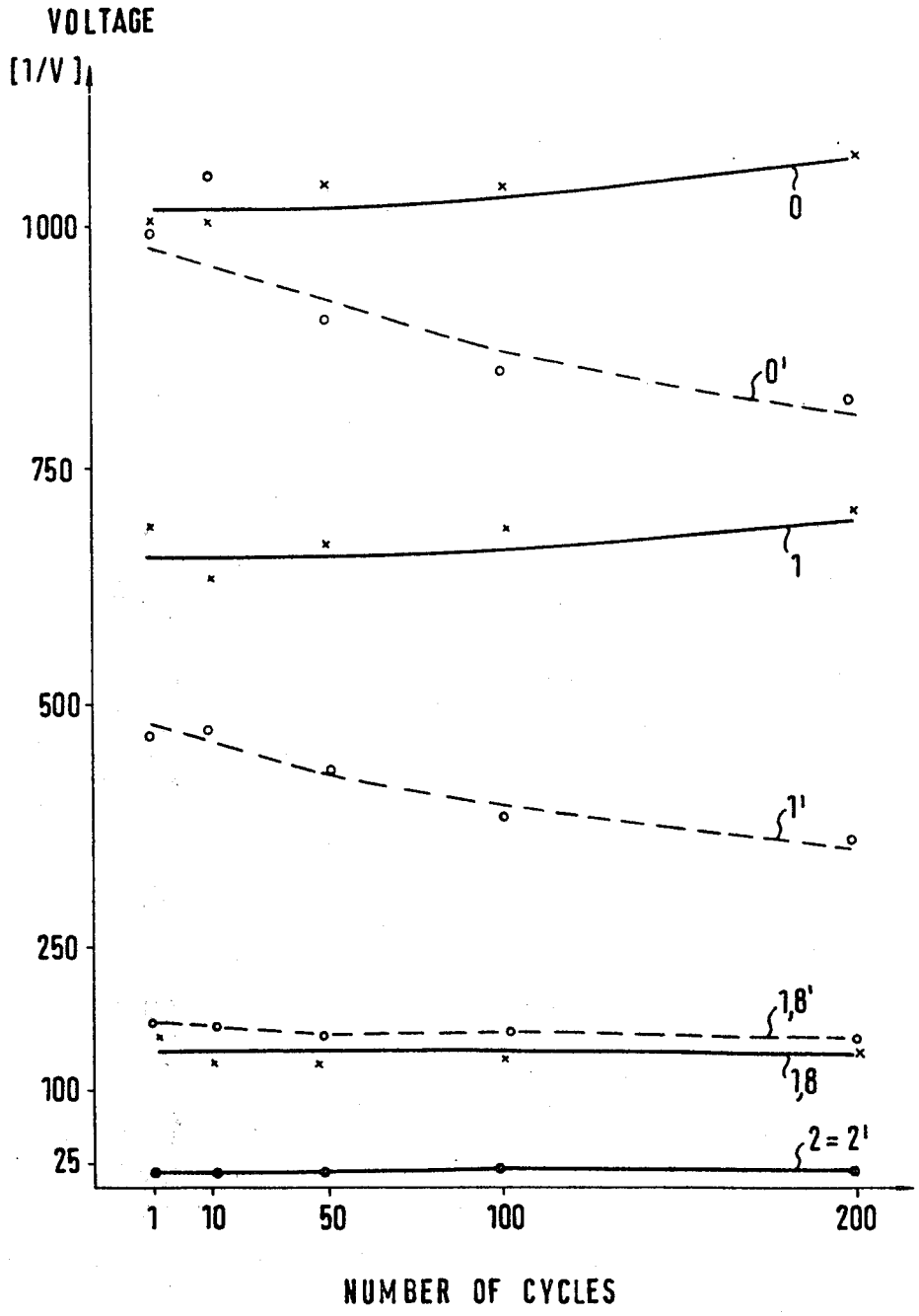
VOLTAGE
[1/V]
1000
750
500
250
100
25
0
0'
1
1'
1,8'
1,8
2 = 2'
1
10
50
100
200
NUMBER OF CYCLES

ELECTROPHOTOGRAPHIC MEMBER OF SE-TE-AS WITH HALOGEN

The present invention relates to an electrophotographic member consisting of a metal substrate having a photosensitive selenium-tellurium alloy layer deposited thereon.

Electrophotographic members of this kind are used, for example, in photocopying machines. In such machines, the electrophotographic member is usually a coated aluminum drum, i.e., the aluminum drum forms the metallic substrate for the photosensitive selenium-tellurium alloy layer.

Selenium is preferably used for the photosensitiver layers of electrophotographic members because it has good photoconductive properties but exhibits poor conductivity in the dark. Both properties are of importance for the sequence of operations in photocopying machines or other equipment using electrophotographic members. The electrophotographic member is first charged in the dark at its surface. If selenium is used, a positive charge is applied. Because of the poor dark conductivity of the selenium, this charge is retained for some time. When the surface is exposed to an optical image, charge-carrier pairs are produced in the selenium which result in nonimage areas dissipating the charge. The surface-charge pattern is developed with a toner, and the image thus retained on the electrophotographic member is transferred to paper or other materials. The surface-charge pattern of the electrophotographic member is then removed by exposure of the entire area, and any toner still present on the surface is wiped off. The electrophotographic member can then be reused for copying other subject matter.

A disadvantage of the use of selenium as a photoconductive material for electrophotographic members is its low red sensitivity. To improve this sensitivity, tellurium is added to the selenium in quantities between about 5 and 30%. Addition of less than 5% tellurium to selenium results in an increase of red sensitivity which is of little use in practice, and if the selenium contains more than 30% tellurium, the resulting increase in dark conductivity has an unfavourable effect. Only in the case of very fast electrophotographic members, where a complete copying cycle is shorter than the drop in surface potential due to the increase in dark conductivity, may it be appropriate to add more than 30% tellurium.

The electrophotographic member is commonly sensitized by exposing it to corona discharge. A voltage of, e.g., 6 kV is applied between the electrophotographic member and the corona electrode. If the electrophotographic member is a coated aluminum drum rotating at 60 r/min, the drum will be charged to 1000 V during the first revolution. If the drum is now discharged prior to the end of each revolution and then charged again, and if this is done in 200 successive cycles, it will be found that the drum is charged to only 800 V in the 200th cycle. If the potential is measured after exposure to one lux-second, it will be found to decrease from about 500 V at the beginning to only 350 V after the 200th cycle. This drop of potential results in the reproducibility of gray tones deteriorating from one cycle to another. To reattain the original potential values after charging, a pause of several minutes is necessary during which the electrophotographic member is not subjected to any exposure and charging.

The object of the invention is to provide an electrophotographic member consisting of a metal substrate having a photosensitive selenium-tellurium alloy layer of at least 5% tellurium deposited thereon whose charging potentials in the dark and after exposure and recharging deviate less than in the case of conventional electrophotographic members even after several 100 successive equal work cycles.

According to the invention, an electrophotographic member of the above kind has a selenium-tellurium alloy layer which contains 10–5,000 ppm of a metallic element of the fifth main group. Suitable metallic elements are arsenic, antimony or bismuth. The addition of such elements has precisely the required effect, i.e., that no fall of charging potential can be observed even after many successive work cycles.

At a lower value of 10 ppm, the desired effect is at its lower detection limit. At 20–50 ppm, it is already very pronounced; any further addition does not result in a further considerable improvement. However, disadvantages will result from the addition of a metallic element of the fifth main group only at much higher values, namely at about 5,000 ppm, when the metallic element causes an increase in residual potential which can no longer be compensated for by a doped halogen. The residual potential is highly undesirable for electrophotographic members, particularly in photocopying machines, for it means that a charged electrophotographic member cannot be completely discharged. This results in a considerable degradation of gray-level reproduction.

Particularly good stability of the charging potentials has so far been achieved by the use of arsenic. In a selenium-tellurium alloy layer containing 10–20% tellurium, 10–50 ppm, preferably 20–40 ppm, arsenic are used. The most advantageous percentage of tellurium is determined by the operating speed of the electrophotographic member. For a copying drum rotating at 60 r/min, the use of a selenium-tellurium alloy of about 15% tellurium has proved advantageous. Less or more tellurium can be used for drums rotating at lower or higher speeds, respectively. For a drum rotating at 30 r/min, for example, about 7.5% tellurium in the selenium-tellurium alloy layer have proved aadvantageous.

In the case of high-speed drums, a rise of charging potential may result instead of the above-described fall. The fall is prevented by the addition of the metallic element of the fifth main group, and residual potentials may result in a rise. To substantially prevent this rise, a halogen, which, as is well known, lowers residual potentials, is preferably added to the selenium-tellurium alloy layer containing a metallic element of the fifth main group. The halogen doping level ranges between about 10 and 100 ppm, preferably between 10 and 30 ppm, if about 20–50 ppm arsenic are used. At higher arsenic doping levels the halogen component must also be increased.

Additions of arsenic to selenium coatings on electrophotographic members have been known for a long time, e.g., from U.S. Pat. No. 2,803,542 (0.5–20% arsenic), U.S. Pat. No. 2,822,300 (1–48.7% arsenic), U.S. Pat. No. 3,312,548 (0.5–50% arsenic), and a book by R. M. Schaffert, "Electrophotography", 1975, page 300 (more than 1% arsenic). All these publications relate to the production of an increase in the photosensitivity of a selenium layer of an electrophotographic member by adding at least 0.5% arsenic. By contrast, the present invention for the first time makes use of the discovery that the charging potentials of a selenium-tellurium alloy layer can be stabilized by adding to the layer small quantities, in the range of 10–5,000 ppm, of a metallic element of the fifth main group if the work cycles follow each other in rapid succession.

In a preferred embodiment of the invention, an electrophotographic member has a selenium-tellurium alloy layer of 15% tellurium, 40 ppm arsenic, and 40 ppm chlorine. An example of the manufacture of such an electrophotographic member and its properties will be explained in the following. The example applies analogously to electrophotographic members in which the selenium-tellurium alloy layer is doped with antimony or bismuth, which are physically and chemically very similar to arsenic.

The example relates to the manufacture of an aluminum drum provided with a photosensitive layer, as is used in photocopying machines. The aluminum drum is typically about 120 mm in diameter and about 300 mm in length. It is degreased in a trichloroethylene bath under the action of ultrasound, and freed from dirt particles. Then, it is rotatably mounted in a vacuum vessel which is evacuated to about $10^{-4}$ torrs. By a glow discharge, the drum is heated to 50°–70° C., typically 55° C., and held at this temperature throughout the evaporation of the photosensitive layer. Located below the aluminum drum at a distance of about 40–50 mm is a molybdenum boat which is of about the same length as the aluminum drum and in which the substance to be evaporated is heated to about 250° C.

The evaporating substance is a selenium-tellurium alloy of 15% tellurium, 40 ppm arsenic, and 40 ppm chlorine. Experiments have shown that the selenium-tellurium alloy with the doped metallic element of the fifth main group and the doped halogen is quantitatively evaporated and quantitatively deposited on the aluminum drum. The quantities given in the foregoing and in the claims relate, strictly speaking, to the quantity ratio of the elements in the alloy to be evaporated. As no differences in the quantity ratios of the individual elements could be determined between the substance to be evaporated and the evaporated substance, these quantity ratios are set equal. The doped selenium-tellurium alloy used as a starting material is present in the form of fine granular material.

Within two hours, a selenium-tellurium layer about 50–60 μm in thickness is deposited by evaporation from the molybdenum boat having a temperature of 250° C. Finally, air is slowly admitted to the vacuum chamber and the finished electrophotographic member is removed.

In the accompanying drawing, the charging voltages of a drum produced in this way and of a conventional photocopying drum with 7.5% tellurium in the selenium and 20 ppm chlorine and without arsenic are plotted versus the number of successive work cycles. Each of the drums was mounted in a photocopying machine and operated at a rotational speed of 60 r/min. Between the photocopying drum and a corona electrode a voltage of 6 kV was applied. Within each work cycle, the drum was discharged again. Under different experimental conditions, the drum was exposed to a given amount of light prior to the discharge. The voltage between drum and ground was measured after one, ten, fifty, one hundred, and two hundred work cycles. The values measured on the conventional photocopying drum are shown as circles, and the extrapolated measured curve is shown as a broken line. The values measured on the improved photocopying drum are shown as crosses, and the associated extrapolated curve is shown as a continuous line.

The upper two curves are designated 0 and 0'. This is to indicate that no exposure took place, i.e., that the drums were only charged and discharged in each work cycle. From the curve 0' for the conventional drum it is apparent that the voltage decreases from about 1,000 V in the first work cycle to about 800 V after 200 work cycles. it is not untial after a pause of several minutes that 1,000 V are reached again in a new, first work cycle. Compared with this, the values measured on the improved drum and considerably stabler. From the measured curve 0 it is apparent that the voltage rises from about 1,000 V at the beginning to about 1,070 V after the 200th work cycle. Thus, while the voltage of the conventional drum drops by 20%, the improved drum coated with an arsenic-doped selenium-tellurium alloy shows a voltage rise by about 7%.

The two curves 1 and 1' below the two curves 0 and 0' relate to measurements for which the drums were exposed to one Lux-second in each cycle. Besides stabilizing the drum voltages, the use of arsenic-doped selenium-tellurium alloys also increases the voltage value. The curve 1 for the approved drum shows that the voltages are about 650 V and about 690 V after one cycle and after 200 cycles, respectively. By contrast, the curve 1' for the conventional drum shows about 490 V and 350 V, respectively. The voltage values for the conventional drum, which are lower from the beginning and further decrease with each further cycle, result in middle gray tones being reproducible in a considerably lower quality than with an improved drum.

The lowermost curve 2=2', which runs at about 25 V, represents the residual potential of the drums, which is achieved when the drum is exposed to at least about 2 lux-seconds. The residual potentials are about the same for the improved drum and the conventional drum. Even if very high exposure levels of, e.g., about 1.8 lux-seconds are chosen, which discharge the drums to the vicinity of the residual potential, no appreciable differences between an improved drum and a conventional drum will result. With the aforementioned exposure of 1.8 lux-seconds, a curve 1,8 and a curve 1,8' will be obtained for the improved drum and the conventional drum, respectively. Both curves run at about 150 V, irrespective of the number of cycles.

Thus, the addition of a metallic element of the fifth main group to a selenium-tellurium alloy results in a stabilization of the charging voltages of electrophotographic members even if many work cycles follow each other in quickly succession. The improvement is clearly apparent particularly at high voltage values, which are important for the reproduction of middle gray tones.

While the invention has been described with particular reference to a metallic substrate in the form of an aluminum drum as is used in photocopying machines, it is not intended to be limited to this embodiment; it is also possible, for example, to use a plate or any other form of the substrate, which may also be made of metals other than aluminum.

The improvement in the stabilization of the charging voltages has a particularly favourable effect in photocopying drums which are used in photocopying machines together with a wet toner and/or a plastic friction member for cleaning the drum by wiping off any residual toner. In such arrangements, a particularly great decrease in charging potential with increasing number of successive work cycles was hitherto observed.

We claim:

1. An electrophotographic member comprising: a metal substrate; and a photosensitive layer deposited on said substrate, said layer including an alloy of selenium and tellurium, said layer being about 15 percent tellurium, said layer also including between about 20–40 ppm of arsenic and between about 20–30 ppm of a halogen.

* * * * *